United States Patent [19]

Angevine et al.

[11] Patent Number: 4,519,900

[45] Date of Patent: May 28, 1985

[54] ZEOLITE CONTAINING CATALYST SUPPORT FOR DENITROGENATION OF OIL FEEDSTOCKS

[75] Inventors: Philip J. Angevine, West Deptford; Stephen M. Oleck, Moorestown; Robert C. Wilson, Jr., Woodbury; Sadi Mizrahi, Cherry Hill, all of N.J.

[73] Assignee: Mobil Oil Corporation, New York, N.Y.

[21] Appl. No.: 583,807

[22] Filed: Mar. 2, 1984

Related U.S. Application Data

[63] Continuation of Ser. No. 453,969, Dec. 28, 1982, abandoned.

[51] Int. Cl.[3] ..... C10G 45/00; C10G 45/12

[52] U.S. Cl. ..... 208/254 H; 208/216 R; 208/217

[58] Field of Search ..... 208/254 H, 216 R, 217

[56] References Cited

U.S. PATENT DOCUMENTS

| | | | |
|---|---|---|---|
| 3,238,123 | 3/1966 | Voorhies et al. | 208/254 H |
| 3,394,074 | 7/1968 | Buchmann et al. | 208/254 H |
| 3,592,760 | 7/1971 | Young et al. | 208/254 H |
| 3,790,471 | 2/1974 | Argauer et al. | 252/455 Z |
| 3,817,855 | 6/1974 | Smith et al. | 208/254 H |
| 3,835,027 | 9/1974 | Ward et al. | 208/216 PP |
| 3,891,539 | 6/1975 | Nelson et al. | 208/25 H |
| 4,356,079 | 10/1982 | Desaau | 208/10 |
| 4,357,232 | 11/1982 | Holland et al. | 208/87 |

OTHER PUBLICATIONS

*Kirk-Othmer Encyclopedia of Chemical Technology*, "Oil Shale", Third Edition, vol. 16, pp. 333-357, (1981).

*Primary Examiner*—Delbert E. Gantz
*Assistant Examiner*—Chung K. Pak
*Attorney, Agent, or Firm*—Alexander J. McKillop; Michael G. Gilman; Stanislaus Aksman

[57] ABSTRACT

There is provided a zeolite containing catalyst support for denitrogenation of oil feedstocks such as shale oil. The denitrogenation catalyst contains an active hydrogenation catalyst component such as a nickel/molybdenum catalyst.

13 Claims, 2 Drawing Figures

EFFECT OF ZSM-5 ON CATALYST SELECTIVITY

ZEOLITE CONTAINING CATALYST SUPPORT FOR DENITROGENATION OF OIL FEEDSTOCKS

CROSS REFERENCE TO RELATED APPLICATIONS

This is a continuation of copending application Ser. No. 453,969, filed on Dec. 28, 1982 now abandoned.

This application is related to copending application Ser. No. 346,439, filed Feb. 8, 1982 in the name of Stephen M. Oleck et al entitled PROCESS FOR HYDROTREATING PETROLEUM RESIDUA AND CATALYST THEREFOR, which is in turn related to copending application Ser. No. 310,550, filed Oct. 13, 1981, in the name of Frederick Banta et al entitled PROCESS FOR HYDROTREATING PETROLEUM RESIDUA AND CATALYST THEREFOR.

BACKGROUND

This invention relates to a zeolite-containing catalyst for denitrogenation of hydrocarbon feedstocks.

It is well known that many if not most hydrocarbon feedstocks contain contaminants, as for example sulfur, nitrogen and metals. It is desirable, particularly if these feedstocks are to be further processed, that the contaminants be removed. This is an operation usually requiring use of a catalyst.

The high nitrogen content of shale oil is perhaps the major limitation in upgrading it to a refinable syncrude. The primary mode of denitrogenation is by conventional, catalytic hydrotreating.

It has been conventional in the art to effect sulfur removal from hydrocarbon stocks by subjecting them to treatment with hydrogen at elevated temperature and pressure while in contact with a catalyst containing hydrogenating components. Typically the hydrogenating components of such prior art catalysts are Group VI-B or Group VIII metals, or their oxides or sulfides. These hydrogenating components may be supported on a variety of well-known carriers, for example, alumina, kieselguhr, zeolitic molecular sieves and other materials having high surface areas; U.S. Pat. No. 4,080,296. U.S. Pat. No. 3,546,103 teaches hydrodesulfurization with a catalyst of cobalt and molybdenum on an alumina base. U.S. Pat. No. 3,755,145 describes a process for preparing lube oils characterized by low pour points which utilizes a catalyst mixture comprising hydrogenation components, a conventional cracking catalyst which can be either crystalline or amorphous and a crystalline aluminosilicate of the ZSM-5 type.

U.S. Pat. No. 3,894,938 relates to the catalytic dewaxing and desulfurization of high pour point, high sulfur gas oils to lower their sulfur content by contacting such an oil first with a ZSM-5 type zeolite hydrodewaxing catalyst which may contain a hydrogenation/dehydrogenation component in the presence or absence of added hydrogen followed by conventional hydrodesulfurization processing of the dewaxed intermediate.

Copending application Ser. No. 310,550, filed Oct. 13, 1981, discloses and claims a single stage operation for hydrotreating and hydrodewaxing of petroleum residua using a dual catalyst system, i.e. a hydrodesulfurization catalyst combined with a metal-containing ZSM-5 hydrodewaxing catalyst.

Copending application Ser. No. 346,439, filed Feb. 8, 1982, discloses and claims a process for simultaneously hydrodesulfurizing and hydrodewaxing a petroleum residua using an active hydrotreating catalyst component supported on a zeolite-containing catalyst support.

SUMMARY

According to one aspect of the invention there is provided an improved process for the denitrogenation of a nitrogeneous hydrocarbon feedstock, said process employing a hydrotreating catalyst comprising an active hydrogenation component and an alumina support, the improvement comprising incorporating in said alumina support a crystalline aluminosilicate zeolite having a silica to alumina molar ratio of at least about 12 and a Constraint Index within the approximate range of about 1 to 12, the amount of said zeolite being sufficient to increase the denitrogenation/hydrogen consumption selectivity of said catalyst composition.

According to another aspect of the invention, there is provided a process for the catalytic denitrogenation of a nitrogeneous hydrocarbon feedstock, said process consisting essentially of contacting a mixture of hydrogen and said feedstock at a hydrogen pressure of from about 500 to 3,000 psig, a temperature of from about 600° to 850° F. and a space velocity of from about 0.1 to 5.0 LHSV with a catalyst consisting essentially of 5–40 wt. % of a zeolite, 95–60 wt. % of alumina, based on alumina plus zeolite, and 10–30 wt. %, expressed as oxides, of at least one Group VIII metal selected from the group consisting of nickel, cobalt and iron, and at least one Group VIB metal, based on total catalyst, said zeolite being a crystalline aluminosilicate zeolite having a silica to alumina ratio of at least about 12 and a Constraint Index within the approximate range of 1 to 12.

According to another aspect of the invention, there is provided a process for the denitrogenation of shale oil, said process employing a hydrotreating catalyst composition comprising an active hydrogenation component and an alumina support, said alumina support comprising a crystalline aluminosilicate zeolite having a silica to alumina molar ratio of at least about 12 and a Constraint Index within the approximate range of about 1 to 12, the amount of said zeolite being sufficient to increase the denitrogenation/hydrogen consumption selectivity of said catalyst composition.

According to another aspect of the invention, there is provided a process for the catalytic denitrogenation of shale oil, said process consisting essentially of contacting a mixture of hydrogen and said shale oil at a hydrogen pressure of from about 500 to 3,000 psig, a temperature of from about 600° to 850° F. and a space velocity of from about 0.1 to 5.0 LHSV with a catalyst consisting essentially of 5–40 wt. % of ZSM-5, 95–60 wt. % of alumina, based on alumina plus zeolite, and 10–30 wt. %, expressed as oxides, of nickel and molybdenum.

DETAILED DESCRIPTION

Figure 1:
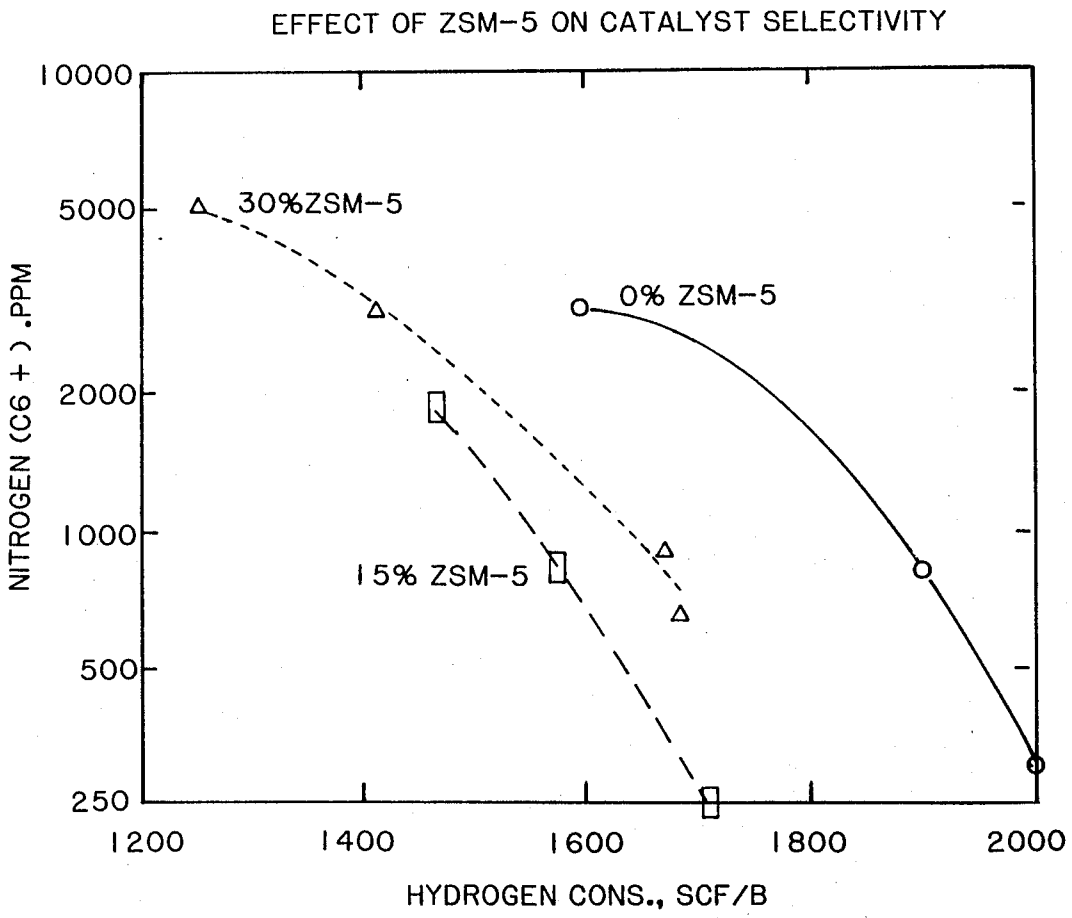
FIG. 1 shows the effect of ZSM-5 on catalyst denitrogenation/hydrogen consumption.

The relative proportion of Group VIII metal to Group VIB metal, expressed as oxides, in the novel system of this invention is not narrowly critical but the Group VIB metal, e.g. molybdenum, is usually utilized in greater amounts than the Group VIII metal, e.g. nickel. In general, the weight of Group VIB metal to Group VIII metal, expressed as oxides, based on total catalyst should range from 2 to 5 with 3 to 4 being particularly preferred.

Examples of active hydrogenation components are combinations of oxides or sulfides of metals selected from the group consisting of (i) nickel and molybdenum, (ii) nickel and tungsten, and (iii) cobalt and molybdenum.

Typical process conditions utilized in carrying out the novel process of this invention include a hydrogen pressure of about 500–3000 psig, a temperature of about 600°–850° F., and 0.1–5 LHSV based on the total complement of catalyst in the system.

The crystalline zeolite component of the catalyst composition of the present invention comprises a member of a particular class of zeolitic materials which exhibit unusual properties. Although these zeolites have unusually low alumina contents, i.e. high silica to alumina mole ratios, they are very active even when the silica to alumina mole ratio exceeds 30. The activity is surprising, since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning carbonaceous deposits with oxygen-containing gas such as air.

An important characteristic of the crystal structure of this particular class of zeolites is that it provides a selective constrained access to and egress from the intracrystalline free space by virtue of having an effective pore size intermediate between the small pore Linde A and the large pore Linde X, i.e. the pore windows of the structure are of about a size such as would be provided by 10-membered rings of silicon atoms interconnected by oxygen atoms. It is to be understood, of course, that these rings are those formed by the regular disposition of the tetrahedra making up the anionic framework of the crystalline zeolite, the oxygen atoms themselves being bonded to the silicon (or aluminum, etc.) atoms at the centers of the tetrahedra.

The silica to alumina mole ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina mole ratio of at least 12 are useful, it is preferred in some instances to use zeolites having substantially higher silica/alumina ratios, e.g. 1600 and above. In addition, zeolites as otherwise characterized herein but which are substantially free of aluminum, that is zeolites having silica to alumina mole ratios of up to infinity, are found to be useful and even preferable in some instances. Such "high silica" or "highly siliceous" zeolites are intended to be included within this description. Also to be included within this definition are substantially pure silica zeolites, that is to say those zeolites having no measurable amount of aluminum (silica to alumina mole ratio of infinity) but which otherwise embody the characteristics disclosed.

Members of this particular class of zeolites, after activation, acquire an intracrystalline sorption capacity for normal hexane which is greater than that for water, i.e. they exhibit "hydrophobic" properties. This hydrophobic character can be used to advantage in some applications.

Zeolites of the particular class useful herein have an effective pore size such as to freely sorb normal hexane. In addition, their structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross section than normal hexane is excluded and the zeolite is not of the desired type. Windows of 10-membered rings are preferred, although in some instances excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons and, therefore, it is not the present intention to entirely judge the usefulness of a particular zeolite solely from theoretical structural considerations.

Rather than attempt to judge from crystal structure whether or not a zeolite possesses the necessary constrained access to molecules of larger cross-section than normal paraffins, a simple determination of the "Constraint Index" as herein defined may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 540° C. for at least 15 minutes. The zeolite is then flushed with helium and the temperature is adjusted between 290° C. and 510° C. to give an overall conversion of between 10 percent and 60 percent. The mixture of hydrocarbons is passed at 1 liquid hourly space velocity (i.e., 1 volume of liquid hydrocarbon per volume of zeolite per hour) over the zeolite with a helium dioxide to give a helium to (total) hydrocarbon mole ratio of 4:1. After 20 minutes on stream, a sample of the effluent is taken and analyzed, most conveniently by gas chromatography, to determine the fraction remaining unchanged for each of the two hydrocarbons.

While the above experimental procedure will enable one to achieve the desired overall conversion of 10 to 60 percent for most zeolite samples and represents preferred conditions, it may occasionally be necessary to use somewhat more severe conditions for samples of very low activity, such as those having an exceptionally high silica to alumina mole ratio. In those instances, a temperature of up to about 540° C. and a liquid hourly space velocity of less than one, such as 0.1 or less, can be employed in order to achieve a minimum total conversion of about 10 percent.

The "Constraint Index" is calculated as follows:

$$\text{Constraint Index} = \frac{\log_{10}(\text{fraction of hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of about 1 to 12. Constraint Index (CI) values for some typical materials are:

| | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| ZSM-48 | 3.4 |
| TMA Offretite | 3.7 |
| Clinoptilolite | 3.4 |
| Beta | 1.5 |
| H-Zeolon (mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables such as crystal size of the zeolite, the presence of occluded contaminants, etc., may affect the constraint index. Therefore, it will be appreciated that it may be possible to so select test conditions as to establish more than one value in the range of 1 to 12 for the Constraint Index of a particular zeolite. Such a zeolite exhibits the constrained access as herein defined and is to be regarded as having a Constraint Index in the range of 1 to 12. Also contemplated herein as having a Constraint Index in the range of 1 to 12 and therefore within the scope of the defined class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value within the range of 1 to 12. Thus, it should be understood that the Constraint Index value as used herein is an inclusive rather than a exclusive value. That is, a crystalline zeolite when identified by any combination of conditions within the testing definition set forth herein as having a Constraint Index in the range of 1 to 12 is intended to be included in the instant zeolite definition whether or not the same identical zeolite, when tested under other of the defined conditions, may give a Constraint Index value outside of the range of 1 to 12.

The particular class of zeolites defined herein is exemplified by ZSM-5, ZSM-11, ZSM-12, ZSM-23, ZSM-35, ZSM-38, ZSM-48 and other similar materials.

ZSM-5 is described in greater detail in U.S. Pat. No. 3,702,886 and Re 29,948. The entire descriptions contained within those patents, particularly the X-ray diffraction pattern of therein disclosed ZSM-5, are incorporated herein by reference.

ZSM-11 is described in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-23 is described in U.S. Pat. No. 4,076,842. The entire content thereof, particularly the specification of the X-ray diffraction pattern of the disclosed zeolite, is incorporated herein by reference.

ZSM-35 is described in U.S. Pat. No. 4,016,245. The description of that zeolite, and particularly the X-ray diffraction pattern thereof, is incorporated herein by reference.

ZSM-38 is more particularly described in U.S. Pat. No. 4,046,859. The description of that zeolite, and particularly the specified X-ray diffraction pattern thereof, is incorporated herein by reference.

ZSM-48 is more particularly described in published European patent application No. 80 300463, which claims priority to U.S. application Ser. No. 13,640, filed Feb. 21, 1979, and Ser. No. 64,703, filed Aug. 8, 1979. The description of that zeolite, and particularly the specified X-ray diffraction pattern thereof, is incorporated herein by reference.

In all of the foregoing zeolites, the original cations can be subsequently replaced, at least in part, by calcination and/or ion exchange with another cation. Thus, the original cations can be exchanged into a hydrogen or hydrogen ion precursor form or a form in which the original cations have been replaced by a metal of, for example, Groups II through VIII of the Periodic Table. Thus, it is contemplated to exchange the original cations with ammonium ions or with hydronium ions. Catalytically active forms of these zeolites would include, in particular, hydrogen, rare earth metals, calcium, nickel, palladium and other metals of Groups II and VIII of the Periodic Chart.

It is to be understood that by incorporating by reference the foregoing patents to describe examples of specific members of the specified zeolite class with greater particularity, it is intended that identification of the therein disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patents should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The specific zeolites described, when prepared in the presence of organic cations, are substantially catalytically inactive, possibly because the intra-crystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 540° C. for from about 15 minutes to about 24 hours.

Natural zeolites may sometimes be converted to zeolite structures of the class herein identified by various activation procedures and other treatments such as base exchange, steaming, alumina extraction and calcination, alone or in combinations. Natural minerals which may be so treated include ferrierite, brewsterite, stilbite, dachiardite, epistilbite, heulandite, and clinoptilolite.

Preferred crystalline zeolites for utilization herein include zeolite Beta, ZSM-5, ZSM-11, ZSM-12, ZSM-23, ZSM-35, ZSM-38, and ZSM-48, with ZSM-5 being particularly preferred.

Crystalline zeolites used in the present invention will generally have a crystal dimension of from about 0.01 to 100 microns, more preferably from about 0.02 to 10 microns.

In a preferred aspect of this invention, the zeolites hereof are selected as those providing among other things a crystal framework density, in the dry hydrogen form, of not less than about 1.6 grams per cubic centimeter. It has been found that zeolites which satisfy all three of the discussed criteria are most desired for several reasons. Therefore, the preferred zeolites useful with respect to this invention are those having a Constraint Index as defined above of about 1 to about 12, a silica to alumina mole ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article ZEOLITE STRUCTURE by W. M. Meier. This paper, the entire contents of which are incorporated herein by reference, is included in PROCEEDINGS OF THE CONFERENCE ON MOLECULAR SIEVES, (London, April 1967) published by the Society of Chemical Industry, London, 1968.

When the crystal structure is unknown, the crystal framework density may be determined by classical pyknometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space.

It is possible that the unusual sustained activity and stability of this special class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of this invention, are:

| | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |

-continued

| | Void Volume | Framework Density |
|---|---|---|
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used as precursors to the transition metal modified zeolites of the present invention. Thus, the original alkali metal of the zeolite may be replaced by ion exchange with other suitable metal cations of Groups I through VIII of the Periodic Table, including, by way of example, nickel, copper, zinc, palladium, calcium or rare earth metals. As indicated, it is generally the hydrogen form of the zeolite component which is ion exchanged with transition metal in accordance with the present invention.

As has heretofore been stated, an essential ingredient of the catalyst of this invention is alumina. Alumina may be present in the catalyst in amounts ranging from 60 to 95 weight percent based on the weight of alumina plus zeolite. As is well known by those skilled in the art, the characteristic of composited alumina catalyst depends to a very large extent on the properties of the alumina.

Aluminas possessing characteristics which are eminently suitable for the preparation of the catalyst of this invention are manufactured by the American Cyanamid Company under their trade name PA Alumina Powder, manufactured by Kaiser Aluminum and Chemical Corporation under their trade name SA Alumina Powder, as well as one manufactured by Conoco Chemical Company under their trade name CATAPAL SB.

The catalyst of this invention is typically prepared by mixing a zeolite such as ZSM-5 with a suitable alumina following by extruding, calcining, exchanging to low sodium content, drying, impregnating with a Group VIB metal salt solution, drying, impregnating with a Group VIII metal salt solution, and re-calcining. Other methods can be employed to prepare the catalyst of this invention.

EXAMPLE

Three $NiMo/Al_2O_3$ catalysts were evaluated in a fixed-bed, down-flow hydroprocessing pilot unit. The properties of the catalysts (A, B and C) are shown in Table 1. The catalysts are 1/32" extrudates made of Kaiser $Al_2O_3$ and having 0, 15, and 30 wt% ZSM-5, respectively. All catalysts were impregnated to 5.0 wt% NiO and 17.0 wt% $MoO_3$. The catalysts were presulfided in a conventional manner prior to the hydrotreating runs. Three similar shale oil samples were used in the catalyst evaluation; the properties of these Paraho shale oils are shown in Table 2. Evaluation data are given in Tables 3 through 5.

In Tables 1–5 the following abbreviations are noted. LHSV stands for liquid hourly space velocity in terms of volume of liquid per volume of catalyst bed. SCFB or SCF/B stands for standard cubic feet per barrel. CHG stands for charge. BP stands for boiling point. EP stands for end point.

In Table 1, the wt % of ZSM-5 and $Al_2O_3$ is based upon the weight of ZSM-5 plus $Al_2O_3$, whereas the wt % of NiO and $MoO_3$ is based upon the entire weight of the catalyst composition.

TABLE 1

Properties of $NiMo/Al_2O_3$ Catalysts

| CATALYST | A | B | C |
|---|---|---|---|
| Composition | | | |
| Support | | | |
| ZSM-5 Wt % | 0 | 15 | 30 |
| $Al_2O_3$, Wt % | 100 | 85 | 70 |
| Catalyst | | | |
| NiO, Wt % | 5 | 5 | 5 |
| $MoO_3$, Wt % | 17 | 17 | 17 |
| Physical Properties | | | |
| Pore Vol, cc/g | 0.589 | 0.609 | 0.566 |
| Surface Area, $m^2/g$ | 186 | 199 | 224 |
| Avg. Pore Dia., Angstrom | 127 | 116 | 101 |
| Density, g/cc | | | |
| Packed | 0.64 | 0.67 | 0.64 |
| Particle | 1.16 | 1.10 | 1.16 |
| Real | 3.64 | 3.36 | 3.36 |
| Pore Vol Distribution | | | |
| PV % in Pores of | | | |
| 0–30 Å Dia. | 11 | 17 | 14 |
| 30–50 | 2 | 3 | 6 |
| 50–80 | 12 | 2 | 17 |
| 80–100 | 9 | 7 | 9 |
| 100–150 | 51 | 31 | 31 |
| 150–200 | 11 | 24 | 14 |
| 200–300 | 1 | 2 | 5 |
| 300+ | 3 | 2 | 4 |

TABLE 2

Properties of Paraho Shale Oil

| Drum No. | 1 | 2 | 3 |
|---|---|---|---|
| API Gravity | 20.9 | 22.2 | 20.5 |
| Sulfur, Wt % | 0.62 | 0.58 | 0.62 |
| Nitrogen, Wt % | 2.1 | 2.0 | 2.1 |
| Pour Point, °F. | — | 75 | — |

TABLE 3

Denitrogenating Paraho Shale Oil With 0% ZSM-5 (Catalyst A)

| Run No. | 1 | 2 | 3 |
|---|---|---|---|
| Avg. Reactor Temp., °F. | 726 | 762 | 794 |
| Pressure, PSIG | 2000 | 2000 | 2000 |
| LHSV | 0.58 | 0.49 | 0.56 |
| $H_2$ Cons., SCF/B Chg | 1585 | 1917 | 2008 |
| Gravity, API | 36.2 | 39.0 | 42.0 |
| Sulfur, Wt % | 0.07 | 0.04 | 0.02 |
| Nitrogen, Wt % | 0.210 | 0.090 | 0.030 |

TABLE 4

Denitrogenating Paraho Shale Oil With 15% ZSM-5 (Catalyst B)

| Run No. | 1 | 2 | 3 |
|---|---|---|---|
| Avg. Reactor Temp., °F. | 725 | 762 | 795 |
| Pressure, PSIG | 2000 | 2000 | 2000 |
| LHSV | 0.56 | 0.60 | 0.61 |
| $H_2$ Cons., SCF/B Chg | 1474 | 1574 | 1710 |

TABLE 4-continued

Denitrogenating Paraho Shale Oil With 15% ZSM-5 (Catalyst B)

| Run No. | 1 | 2 | 3 |
|---|---|---|---|
| Gravity, API | 35.7 | 38.0 | 41.0 |
| Sulfur, Wt % | 0.13 | — | 0.07 |
| Nitrogen, Wt % | 0.180 | 0.088 | 0.025 |
| Pour Point, °F. | 75 | 70 | 40 |

TABLE 5

Denitrogenating Paraho Shale Oil With 30% ZSM-5 (Catalyst C)

| Run No. | 1 | 2 | 3 | 4 |
|---|---|---|---|---|
| Avg. Reactor Temp., °F. | 694 | 725 | 752 | 776 |
| Pressure, PSIG | 2040 | 2035 | 2040 | 2010 |
| LHSV | 0.51 | 0.52 | 0.48 | 0.52 |
| $H_2$ Cons., SCF/B Chg | 1260 | 1418 | 1673 | 1684 |
| Gravity, API | 32.5 | 34.9 | 37.1 | 38.7 |
| Sulfur, Wt % | 0.04 | 0.08 | 0.04 | 0.06 |
| Nitrogen, Wt % | 0.520 | 0.300 | 0.090 | 0.065 |
| Pour Point, °F. | 65 | 55 | 50 | — |

As indicated by the foregoing data, a reduction in pour point can be achieved by the process of the present invention.

FIG. 1 shows the effect of ZSM-5 on catalyst denitrogenation/hydrogen comsumption selectivity. To reach a given product nitrogen level (e.g. 500 ppm), the catalyst with 15% ZSM-5 required approximately 15% less hydrogen (approximately 300 scf/B less). The use of more ZSM-5 apparently has no further benefit in reducing the hydrogen consumption, probably because the large amount of ZSM-5 dilutes the hydrotreating catalyst, requiring higher temperatures for a given level of denitrogenation and thus producing more light gases. It is believed that the zeolite may aid the scission of the C-N bonds by the presence of some residual acidity.

Figure 2:
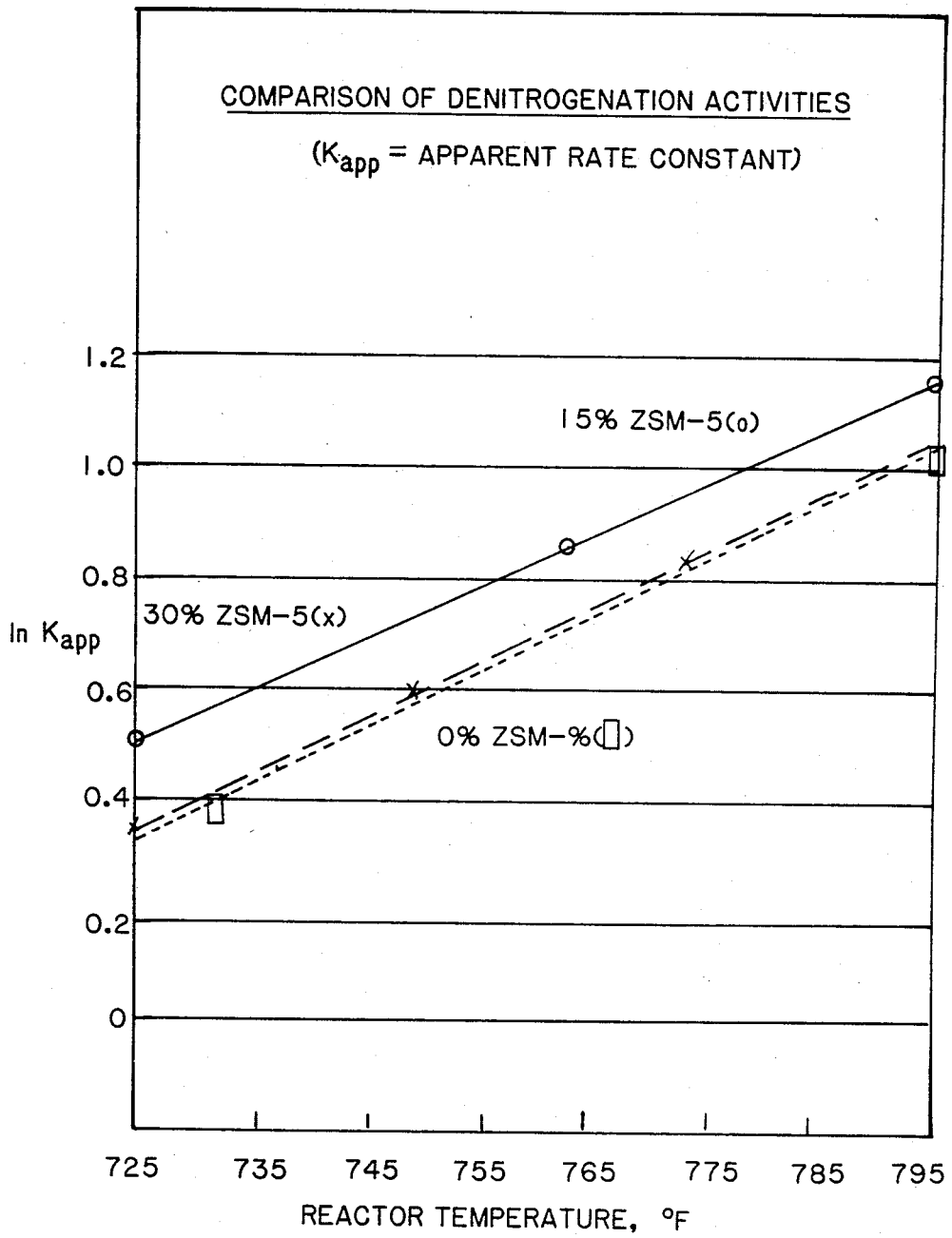
FIG. 2 shows the effect of ZSM-5 on catalyst denitrogenation activity.

FIG. 2 compares the denitrogenation activities of the three catalysts. The catalyst with 15% ZSM-5 was more active by about 15° F. than the catalysts containing 0% and 30% ZSM-5. Thus incorporation of ZSM-5 has the benefit of both improving the denitrogenation activity and the denitrogenation/hydrogen consumption selectivity.

What is claimed is:

1. A process for the catalytic denitrogenation of shale oil, said process consisting essentially of contacting a mixture of hydrogen and said shale oil at a hydrogen pressure of from about 500 to 3000 psig., a temperature of from about 600° to 850° F. and a space velocity of from about 0.1 to 5.0 LHSV with a catalyst consisting essentially of 5–30 wt. % of a zeolite selected from group consisting of zeolite Beta, ZSM-5, ZSM-11, ZSM-12, ZSM-23, ZSM-35, ZSM-38 and ZSM-48, 95–70 wt. % of alumina, based on alumina plus zeolite, and an active hydrogenation component.

2. A process according to claim 1, wherein said active hydrogenation component is selected from the group consisting of Group VI-B or Group VIII metals, oxides of Group VI-B or Group VIII metals, and sulfides of Group VI-B or Group VIII metals.

3. A process according to claim 2, wherein said active hydrogenation component is a combination of oxides or sulfides of metals selected from the group consisting of (i) nickel and molybdenum, (ii) nickel and tungsten, and (iii) cobalt and molybdenum.

4. A process according to claim 3, wherein said zeolite is ZSM-5.

5. A process according to claim 4, wherein said active hydrogenation component contains nickel and molybdenum.

6. A process according to claim 5, wherein said active hydrogenation component constitutes from about 10% to about 30% by weight of said catalyst composition.

7. A process according to claim 6 wherein said alumina support contains 15–30 wt. % of said zeolite.

8. A process for the catalytic denitrogenation of shale oil, said process consisting essentially of contacting a mixture of hydrogen and said shale oil at a hydrogen pressure of from about 500 to 3,000 psig, a temperature of from about 600° to 850° F. and a space velocity of from about 0.1 to 5.0 LHSV with a catalyst consisting essentially of 5–20 wt. % of ZSM-5, 95–70 wt. % of alumina, based on alumina plus zeolite, and 10–30 wt. %, expressed as oxides, of nickel and molybdenum.

9. A process for minimizing the amount of hydrogen consumed in the catalytic hydrotreating of shale oil to denitrogenate said shale oil and upgrade said shale oil to a refinable syncrude, said process consisting essentially of contacting a mixture of hydrogen and said shale oil at a hydrogen pressure of from about 500 to 3,000 psig, a temperature of from about 600° to 850° F. and a space velocity of from about 0.1 to 5.0 LHSV with a catalyst consisting essentially of 5–30 wt. % of a zeolite is selected from the group consisting of zeolite Beta, ZSM-5, ZSM-11, ZSM-12, ZSM-23, ZSM-35, ZSM-38 and ZSM-48 95–70 wt. % of alumina, based on alumina plus zeolite, and 10–30 wt. %, expressed as oxides, of at least one Group VIII metal selected from the group consisting of nickel, cobalt and iron, and at least one Group VIB metal, based on total catalyst, said zeolite being a crystalline aluminosilicate zeolite having a silica to alumina ratio of at least about 12 and a Constraint Index within the approximate range of 1 to 12.

10. A process according to claim 9, wherein said Group VIII metal is nickel and said Group VIB metal is molybdenum.

11. A process according to claim 10, wherein said shale oil comprises at least 2% by weight of nitrogen.

12. A process according to claim 11, whereby the nitrogen content of the shale oil is reduced to no more than 500 ppm.

13. A process according to claim 12 wherein said catalyst contains 15–30 wt. % of said zeolite.

* * * * *

UNITED STATES PATENT AND TRADEMARK OFFICE

CERTIFICATE OF CORRECTION

PATENT NO. : 4,519,900

DATED : May 28, 1985

INVENTOR(S) : ANGEVINE ET AL.

It is certified that error appears in the above-identified patent and that said Letters Patent is hereby corrected as shown below:

Column 4, line 45: "dioxide" should read --dilution--.

Column 11, line 15: "5-20 wt%" should read --5-30 wt.%--.

Column 12, line 2: After "zeolite" insert --which--.

Signed and Sealed this

*Nineteenth* Day of *November 1985*

[SEAL]

*Attest:*

DONALD J. QUIGG

*Attesting Officer*

*Commissioner of Patents and Trademarks*